US006156984A

United States Patent [19]

Droessler

[11] Patent Number: 6,156,984

[45] Date of Patent: Dec. 5, 2000

[54] INDUSTRIAL SAFETY DEVICE

[75] Inventor: Kurt J. Droessler, Crystal Lake, Ill.

[73] Assignee: Schaff International, Ltd., Lake Zurich, Ill.

[21] Appl. No.: 09/428,964

[22] Filed: Nov. 4, 1999

[51] Int. Cl.[7] ..... H01H 9/20

[52] U.S. Cl. ..... 200/334

[58] Field of Search ..... 200/334

[56] References Cited

U.S. PATENT DOCUMENTS

| | | | |
|---|---|---|---|
| 489,570 | 1/1893 | Scribner . | |
| 1,046,227 | 12/1912 | Seemann . | |
| 1,162,996 | 12/1915 | Farrelly et al. . | |
| 2,329,427 | 2/1943 | Vossen . | |
| 2,426,051 | 12/1947 | Reiber . | |
| 2,768,234 | 10/1956 | Popp . | |
| 3,654,411 | 4/1972 | Wohnlich et al. . | |
| 3,843,853 | 10/1974 | Panek et al. . | |
| 4,593,162 | 6/1986 | Rochette | 200/51.09 |
| 5,378,882 | 1/1995 | Gong et al. | 235/472 |
| 5,821,488 | 10/1998 | Falcon | 200/52 R |
| 5,918,731 | 7/1999 | Wecke et al. | 200/329 |

*Primary Examiner*—Michael L. Gellner
*Assistant Examiner*—Nhung Nguyen
*Attorney, Agent, or Firm*—Piper Marbury Rudnick & Wolfe

[57] ABSTRACT

A safety device for industrial applications including a housing for the device. The housing defines a bore at one end and a plunger is positioned in the bore. A an external threaded member with pressure adjustment is engageable with the plunger so that the force required for moving the position of the plunger in the bore can be adjusted. A chamber is defined at the other end of the housing and a switch is positioned within the chamber with the switch being connected to means for operating the industrial equipment. The chamber communicates with the bore containing the plunger and means associated with the switch cause operation thereof in response to movement of the plunger within the bore.

7 Claims, 3 Drawing Sheets

INDUSTRIAL SAFETY DEVICE

BACKGROUND OF THE INVENTION

This invention relates to a device usable with industrial equipment and the like for improving the safety of the equipment operation. The invention is particularly adapted to be employed in conjunction with high speed equipment which is subject to forces that can cause an interruption in the proper operation of the equipment and which can result in damage to persons and/or the equipment if the operation is not terminated in a safe manner.

A particular example of equipment of this type constitutes a pay-out system utilized for purposes of feeding wires, coils or the like to a production line. One example of such a line involves the delivery of wire to equipment designed for making springs or other products. Such lines typically operate at very high speed and require that the wire feeding equipment operate in the same fashion. The equipment ordinarily comprises a large reel holding a considerable length of wire so that the line can operate for a long period of time without interruptions. Thus, the pay-out speed of the wire and the rotational speed of the reel are high in order that the pay-out system can keep up with the line, and this speed is desirably maintained for a considerable time to obtain as much uninterrupted production from the line as possible.

Safety devices in the form of "pull-out" or "breakaway" switches have been used in the past in connection with such industrial equipment. Although not for the same application, U.S. Pat. Nos. 1,162,996 and 3,654,411 generally describe this type of switch. The difficulties encountered in such cases are related to the fact that the switches are designed with parts that separate when subjected to unacceptably high forces. The switch parts are included in the circuit used for the system operation and that circuit is broken and the system shut down when the separation occurs. This is a very abrupt action which only takes place after the unacceptable situation has developed. Danger to employees and/or damage to equipment can still result due, for example, to the momentum of moving parts in the system.

SUMMARY OF THE INVENTION

This invention provides for the use of a safety device which overcomes difficulties encountered with prior art devices used for similar purposes. The device of the invention is useful in connection with the operation of a variety of types of industrial equipment including pay-out systems used for delivering wires, coils or the like to production lines.

The safety device of the invention consists of a housing having at one end a bore for receiving a plunger. This plunger has a first location within the bore which is occupied during normal operation of the equipment with which the device is associated and a second position within the bore which is occupied when an unacceptable operating condition is encountered. The plunger is also adapted to be completely removed from the bore and separated from the housing under extreme operating conditions.

The plunger includes an end extending outwardly of the housing and defining an eyebolt or other means for attachment. In an application of the invention, a plunger eyebolt receives the wire being fed to a production line and tension is therefore applied to the plunger by the wire. When the force applied by the wire is sufficient, the plunger will be moved to the aforesaid second position. Under some circumstances where the force is exceedingly high, the plunger could be completely removed from the housing bore.

The invention contemplates precise control of the force required for affecting the plunger position. This is accomplished by means of a spring loaded ball extending from a side wall of the device housing and into contact with the shaft of the plunger. The pressure applied to the ball can be adjusted so that more or less pulling force by a wire or other element will result in plunger movement.

The safety device housing also defines a separate chamber for receiving a switch. This switch is preferably of the type including a spring-loaded pin normally extending outwardly and adapted to be depressed for opening of the switch. The device housing is designed so that when the switch is positioned in its designated chamber and when the plunger is in the aforementioned first position in the housing bore, the end of the plunger will depress the pin and maintain the switch in the open position. When the plunger has been moved to the second position, the switch pin is extended to close the switch and, of course, this is also true if the plunger is removed from the housing.

The safety device is associated with a controller for the operation of the equipment employing the device. In the normal operation of the equipment with the switch open, no signal is sent to the controller. When the plunger is moved, however, the switch closes and a signal is sent from and back to the controller to advise the controller that undesirable forces have developed in the operation. Thus, when the plunger is moved to the second position, this signal will be instantly recognized by the controller and appropriate action can then be taken to avoid injury and/or equipment damage.

DESCRIPTION OF THE PREFERRED EMBODIMENTS

Figure 1:
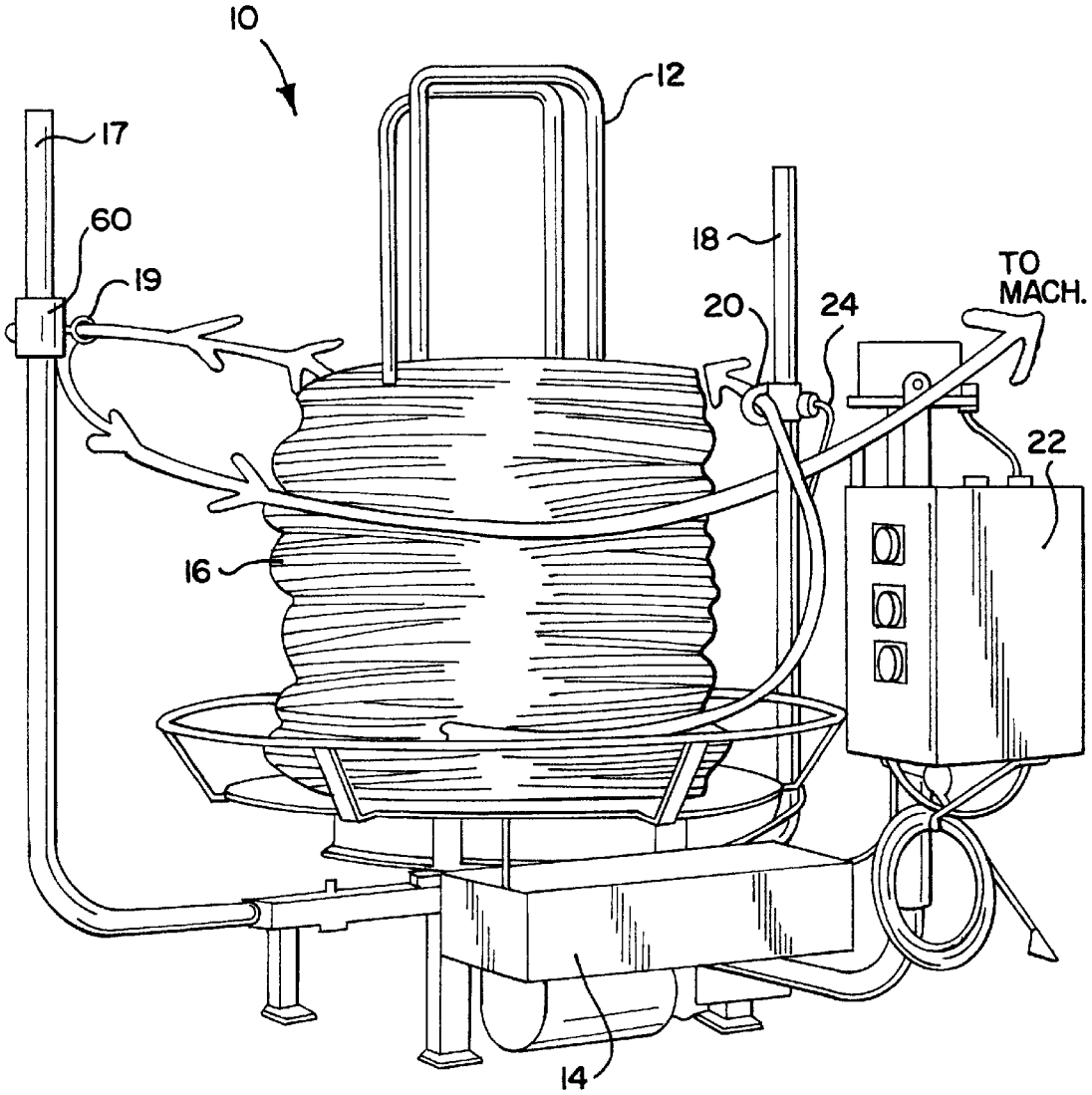
FIG. 1 is a perspective view of a pay-out system for wire adapted for use in conjunction with the safety device of the invention.

FIG. 1 illustrates a pay-out system 10 including a reel construction 12 supported on base 14. The reel is rotatable relative to the base and a coil 16 of wire is positioned for rotation with the reel. A first upwardly extending post 17 is attached to the base and a first eyebolt 19 is carried on the post. A second upstanding post 18 is also attached to the base and a second eyebolt 20 is carried on this post. The wire is fed from the reel through the eyebolts and to production equipment for making springs or for other purposes.

A system controller is positioned at 22 and an electrical cable 24 extends from the controller to the post 18. The safety device of the invention is located on the post 18 and the eyebolt 20 constitutes part of this device.

Figure 2:
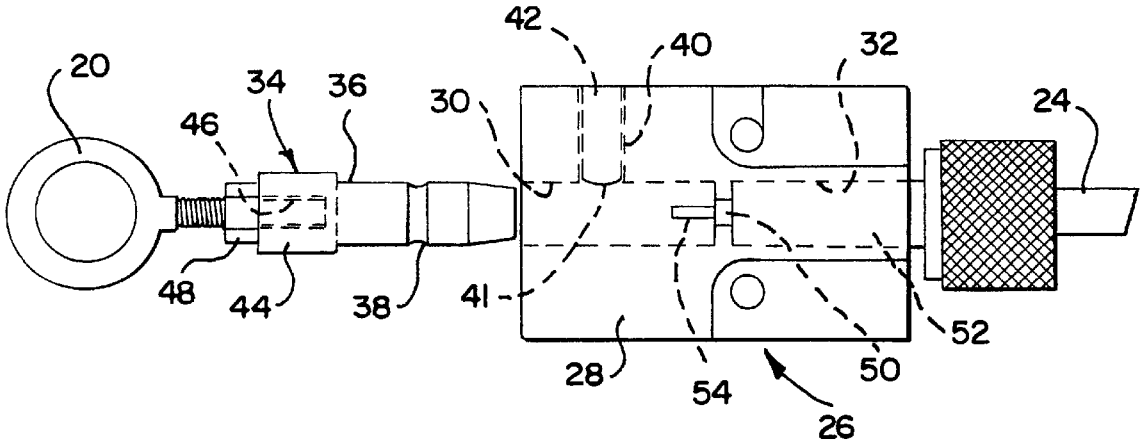
FIG. 2 is a side elevational view of the housing and plunger components of the safety device.
Figure 4:
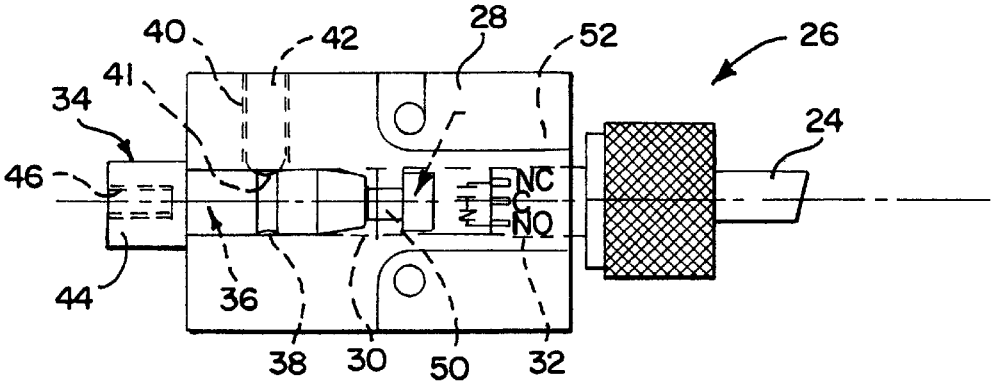
FIG. 4 is a side elevational view of the safety device housing showing the plunger and switch in place and showing the device in association with a system controller.

FIG. 2 illustrates the safety device 26 which includes housing 28 defining bore 30 and chamber 32. A plunger 34 includes shaft 36 which defines an annular reduced diameter groove 38. The diameter of the shaft is such that it will fit snugly within bore 30 without being restricted against movement due to the bore diameter. A second bore 40 extends perpendicular to the bore 30 into communication therewith and externally threaded cylinder 42 which may comprise a conventional set screw supporting a spring loaded ball at its inner end 41 42 is positioned in this second bore. As shown in FIG. 4, when the shaft 36 is positioned within the bore 30 the end 41 of the member 42 is adapted to engage the reduced diameter portion of the shaft comprising groove 38.

The plunger also includes head portion 44 which defines drilled and tapped bore 46. In the embodiment illustrated, this bore receives the threaded end of eyebolt 20 and nut 48 serves to secure the eyebolt relative to the plunger. The eyebolt provides a convenient means for directing coils or wires to production equipment, however, it will be apparent that the threaded bore 46 could receive other devices which are made subject to forces developed in an industrial application.

In addition, the eyebolt could receive some other means such as a rope which is connected to the equipment for purposes of detecting the undesirable conditions.

The chamber 32 of the housing 28 is connected to the bore 30 by means of passage 50 and this chamber is adapted to receive a switch 52. This switch is preferably of the type including a spring loaded pin 54 which normally extends outwardly of the switch (FIG. 2) and which maintains the switch in the closed position when so located. The microprocessor or other typical equipment controllers will ordinarily utilize a continuously operating oscillator or the like for generating low power signals which will be sent through the switch when it is closed so that the controller will immediately recognize the switch condition.

Figure 3:
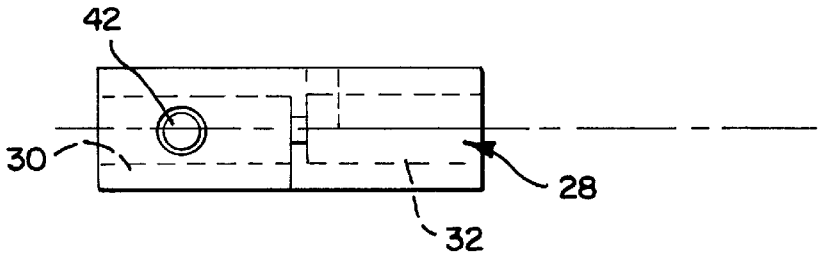
FIG. 3 is a top plan view of the safety device housing.

As illustrated in FIGS. 3 and 4, the device may comprise a rectangular housing. Suitable dimensions comprise a length of 3 inches, width of 2 inches and a height of 1 inch. The bore 30 may be ½ inch in diameter. The switch chamber 32 may be internally threaded (⅜ inch N.P.T.) to receive an externally threaded switch.

Suitable switches for use in the practice of the invention comprise the single pole, single throw switch manufactured by Alco under Part No. MPB 103B and the Alco single pole, double throw switch, Part No. MPE 106F. Although these switches are of the preferred "normally closed" form described, it will be understood that other switches, including normally open switches could be employed. In the latter case, the controller would recognize the absence of a signal and have an appropriate program response to initiate equipment shutdown or other measures.

Figure 5:
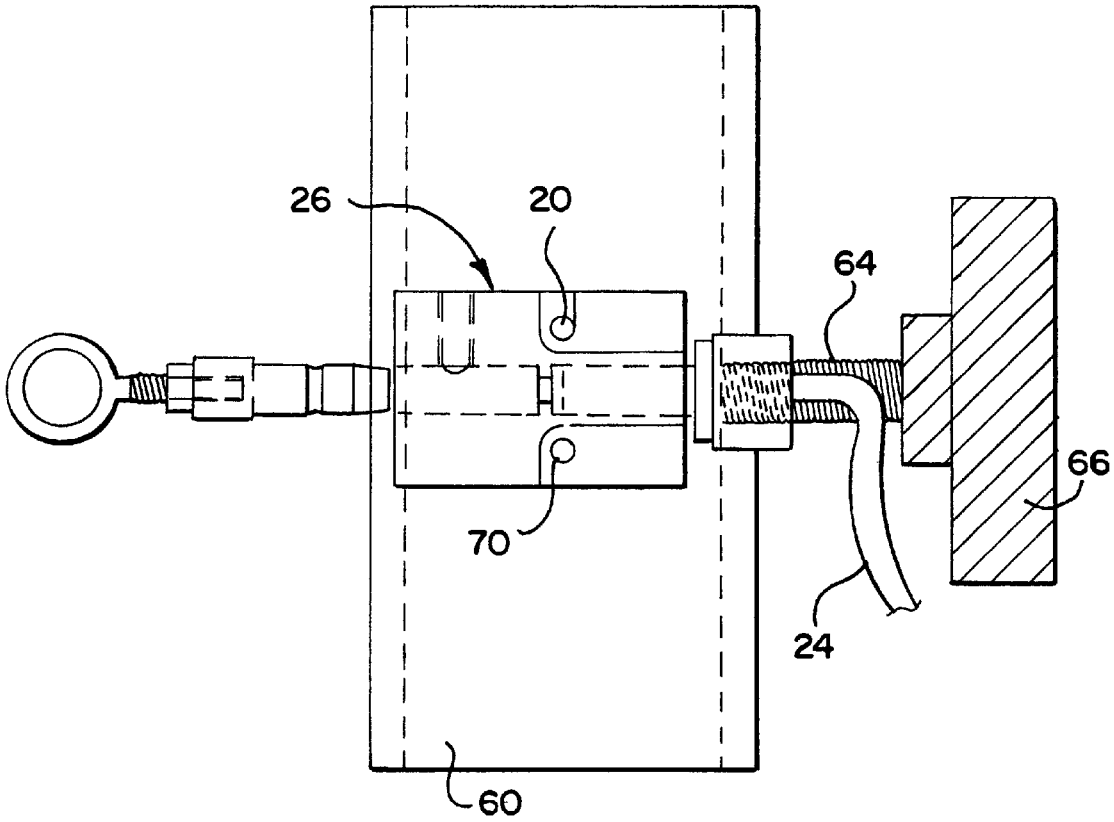
FIG. 5 is a side elevation view illustrating a mounting arrangement for the device; and, FIG. 6 is a top plan view of the mounting arrangement.
Figure 6:
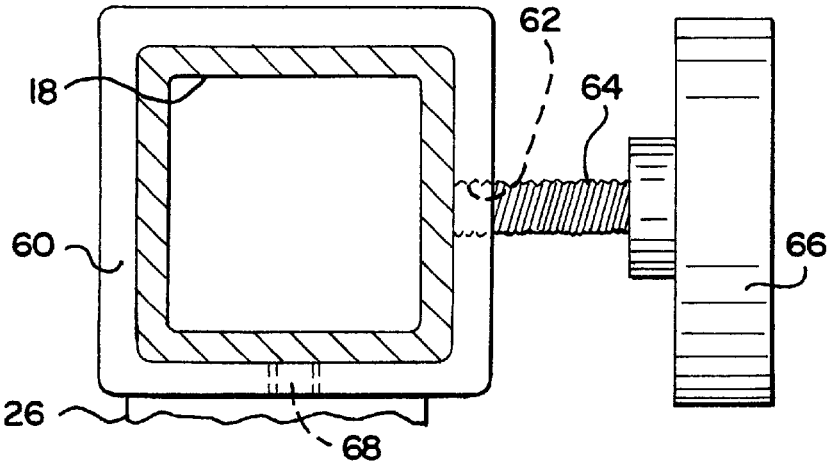

FIGS. 5 and 6 illustrate means for securing the device 26 to the post 18. These means include tubular section 60 which has internal dimensions enabling it to be positioned around post 18 at any desired vertical elevation. A tapped hole 62 in the section 60 receives the threaded shank 64 of clamping knob 66 so that the tubular section can be secured in place by tightening the end of the shank against the side wall of post 18. A pair of tapped holes 68 in section 60 receive screws 70 which extend through the device 26 for securing the device to the section 60.

A corresponding tubular section 60 may be secured to post 17 by means of a corresponding clamping knob. This provides for adjustably locating eyebolt 19.

In the operation of the invention, the adjustment of pressure applied by the end 41 member 42 is of great concern and the preferred setting thereof is best determined by test runs at least until sufficient experience for the running of different operations has been obtained. A pull out force in the range of 6 to 30 pounds is contemplated. Generally speaking, the pull out force for fine wire will be less than for stronger materials, however, operating speed must also be considered in view of the higher forces developed at high speed. The advantages of the invention include the fact that the device has great versatility not only with respect to the types of equipment that can be advantageously employed with the invention but also with respect to the adjustment capability for each application. The ability to set the device to signal the controller when even relatively low increases in force application are encountered is of particular advantage since the equipment can be shut down and allowed to coast rather than being brought to an abrupt halt as has occurred with devices that simply pull out and break an electrical power connection to the equipment. As noted, however, the device also has the "fail safe" feature wherein the plunger would be completely pulled out if an unexpectedly high force were suddenly encountered.

It will be understood that various changes and modifications may be made in the safety device of the invention without departing from the spirit of the invention particularly as defined in the following claims.

I claim:

1. A safety device for industrial applications comprising a housing, a bore defined at one end of the housing, a plunger positioned within said bore, an externally threaded member having an inner end engageable with said plunger for determining the force required for movement of the plunger within the bore, a chamber defined by said housing adjacent to and in communication with said bore, a switch positioned within said chamber, means associated with said switch adapted to extend into said bore for engagement with one end of said plunger when said plunger is in a first position, wherein the plunger is in operating engagement with said means associated with said switch, and means connected to said plunger for applying force thereto and causing movement thereof out of said first position, such movement of said plunger moving the switch from an open to a closed position or from a closed to an open position.

2. A safety device according to claim 1 including a reduced diameter portion defined by said plunger for engagement by said member when the plunger is in said first position, said device moving to a second position within said bore in response to application of said force, said member being out of engagement with said reduced diameter portion when said plunger is in said second position.

3. A safety device according to claim 2 wherein said plunger is adapted to be completely removed from said bore in response to the application of force greater than said force needed to move the plunger to said second position.

4. A safety device according to claim 2 including a second bore defined by said housing perpendicular to and in communication with said first mentioned bore, said second bore being drilled and tapped for adjustably receiving said member.

5. A safety device according to claim 1 wherein said switch includes a spring loaded pin extending into said bore for engagement with said plunger, said switch being held open when the plunger is in said first position and is holding said spring loaded pin in a depressed position.

6. A safety device according to claim 1 including a drilled and tapped bore defined by said plunger at the end thereof opposite said one end.

7. A safety device according to claim 1 wherein said means connected to said plunger comprises an eyebolt received in said drilled and tapped bore.

* * * * *